United States Patent [19]

Kuehnle et al.

[11] 4,275,957

[45] Jun. 30, 1981

[54] OFFSET PLATE IMAGE TRANSFER ATTACHMENT FOR GRAPHIC ART CAMERAS

[75] Inventors: Manfred R. Kuehnle, Lexington; George J. Perry, Sudbury, both of Mass.

[73] Assignee: Coulter Systems Corporation, Bedford, Mass.

[21] Appl. No.: 964,204

[22] Filed: Nov. 28, 1978

Related U.S. Application Data

[63] Continuation-in-part of Ser. No. 802,573, Jun. 1, 1977, abandoned.

[51] Int. Cl.[3] ..... G03G 15/26

[52] U.S. Cl. ..... 355/10; 355/16

[58] Field of Search ..... 355/10, 16, 3 R; 354/3, 354/317, 325; 96/1 R; 427/15, 30

[56] References Cited

U.S. PATENT DOCUMENTS

| | | | |
|---|---|---|---|
| 3,284,224 | 11/1966 | Lehmann | 355/10 X |
| 3,299,787 | 1/1967 | Kolb et al. | 355/10 |
| 3,936,175 | 2/1976 | Jones | 355/3 TR |
| 4,003,651 | 1/1977 | Hashida et al. | 355/15 X |

*Primary Examiner*—William H. Beha, Jr.

*Attorney, Agent, or Firm*—Silverman, Cass & Singer, Ltd.

[57] ABSTRACT

An attachment for a graphic art camera taking the place of the ordinary silver halide film cartridge for use in making a lithographic printing plate. The attachment includes an endless web mounted on rollers. At least a portion of the web is made of flexible electrophotographic film. The electrophotographic film is rotated past a charging station where the film is charged, an exposure station where a latent image is formed, a toning station where the latent image is toned with an ink-receptive toner, and a transfer station. At the transfer station the toned image is transferred from the film portion to a blank lithographic printing plate. The resulting plate is suitable for use in an offset printing press.

77 Claims, 8 Drawing Figures

OFFSET PLATE IMAGE TRANSFER ATTACHMENT FOR GRAPHIC ART CAMERAS

CROSS REFERENCE TO RELATED APPLICATIONS

This application is a continuation-in-part of application Ser. No. 802,573 filed June 1, 1977, now abandoned.

BACKGROUND OF THE INVENTION

The invention relates to the making of lithographic printing plates and more particularly to an attachment for a graphic arts camera for use in making lithographic printing plates using electrophotographic techniques.

Offset plates are made photographically by complex methods requiring the use of silver halide film, photoresists, and the processing of the images to achieve their incorporation onto plates that can be used on printing presses. In recent years electrostatic techniques have also been used to make such plates, but their quality is so inferior to the quality of photographically made plates that this type of technique is utilized rarely.

The invention herein revolves around a type of electrophotographic film that is capable of being imaged with quality and gray scale as good as, if not better than, that achieved by photographic techniques and with resolution that is better than that achieved by photographic techniques. The film includes a photoconductive coating that is bonded onto a conductive substrate. In a preferred form the photoconductive coating comprises a layer of radio frequency sputtered cadmium sulfide that is from about 2,000 Angstroms to about 2 microns thick and the conductive substrate comprises a layer of about 300 to 500 Angstroms thick of indium tin oxide which in turn is disposed on a sheet of stable polyester plastic about 5 mils thick. The film is described in U.S. Pat. No. 4,025,339 issued May 24, 1977.

The film may be exposed at a high speed toned with an ink-receptive toner and the toned image so formed then transferred immediately to a blank lithographic printing plate which enables the entire process to be carried out inside of an attachment or cartridge which takes the place of the usual silver halide photographic film cartridge that is currently used with graphic art cameras. Besides the elimination of the silver halide film this eliminates considerable processing since the plate with the transferred, toned image may subsequently be fixed and then directly immersed in a suitable bath to render the untoned parts ink repellent and then utilized directly as a printing plate in an offset printing press.

SUMMARY OF THE INVENTION

An electrophotographic attachment for a graphic art camera adapted to be mounted to the camera for use in making a lithographic printing plate includes a rotatably mounted endless web including a portion of electrophotographic film material. A charging station, an exposure station, a toning station and an image transfer station. At the image transfer station the tonal image is transferred to a blank lithographic printing plate by pressing the plate against the film as it is rotated through the transfer station or by pressing the film portion against the plate in a fixed position. Once the plate has received the transferred image it may be fixed and then processed for utilizing as a printing plate.

DESCRIPTION OF THE PREFERRED EMBODIMENTS

Offset printing plates are made by a technique which requires that the image to be incorporated into the plate be photographed. The cameras which are used are specialized for the purpose and commence the process by exposing silver halide film contained in cartridges that are secured to the back of the camera at the image plane thereof. The attachment of the invention is intended to replace the silver halide film cartridges used with such cameras.

Figure 1:
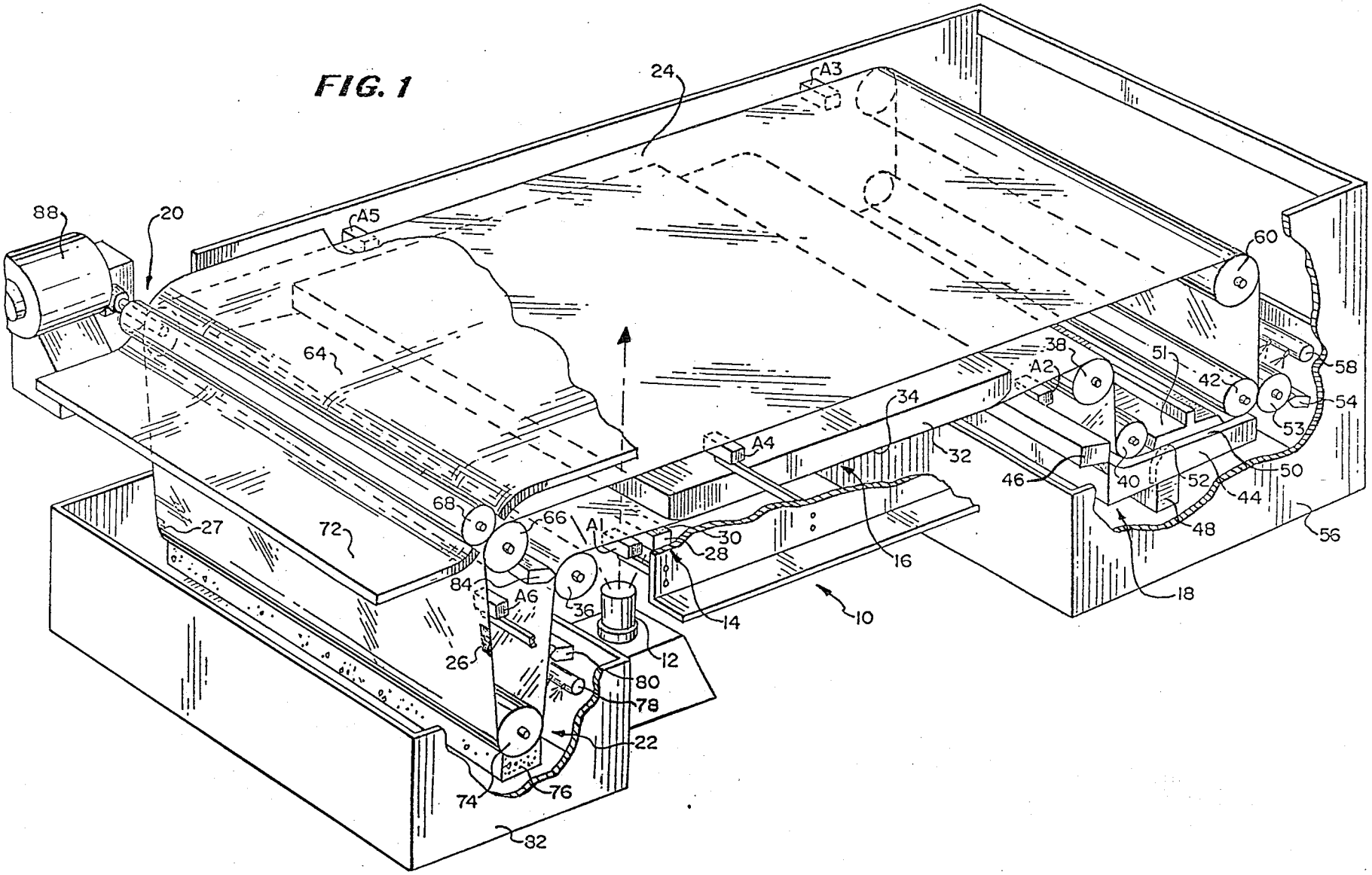
FIG. 1 is a perspective partially sectional view of one embodiment of the attachment of the invention.
Figure 2:
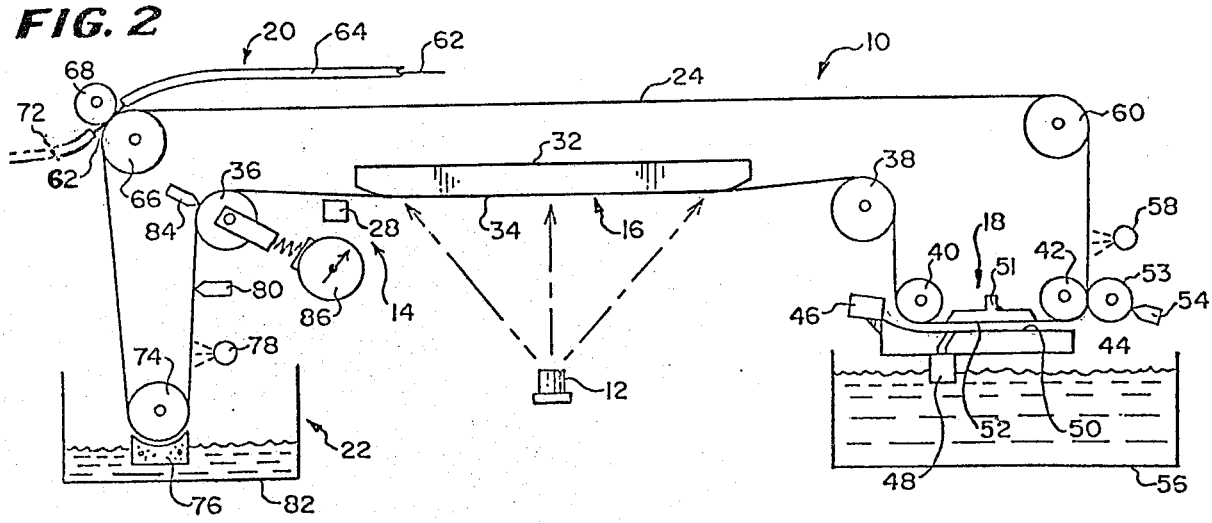
FIG. 2 is a diagram of the attachment of FIG. 1 showing the basic parts and construction thereof.

FIGS. 1 and 2 illustrate one embodiment of the attachment 10 of the invention. The camera system is only shown diagrammatically by a lens 12 but would include the elements previously mentioned. The attachment 10 has been shown totally exposed; however, of course, the attachment 10 and the lens 12 would be married together such that no light would enter the system except as desired through the lens 12. In this respect a cover would be fastened over the attachment 10 which is not illustrated.

The attachment 10 includes a sequence of stations including a charging station 14, an exposure station 16, a toning station 18 and a transfer station 20 which may be followed by an optional cleaning station 22. An endless web 24 is rotated through the stations and the web includes a portion of electrophotographic film upon which the image may be projected and transferred from. The web 24 need only contain a portion of electrophotographic film large enough to cover the area to be imaged in the exposure station 16; however, the web 24 may be made entirely from the electrophotographic film. One electrophotographic film which may be utilized in the invention as previously mentioned is described in U.S. Pat. No. 4,025,339 issued May 24, 1977.

In operation a starting point on the web 24 is chosen, prior to the film portion to be acted upon, such as a point on the periphery of the web 24 which may be a piece of metallic material or strip 26. The strip 26 may then be optically or magnetically sensed as the web 24 passes to the various stations to control the operations and timing of the attachment 10. There may be a second metallic strip 27 on the opposite periphery of the web 24 which may be sensed by sensors on the opposite side of the attachment. The timing of the device may also be accomplished by conventional timing mechanisms such as a timing belt or counter without the use of the sensors and strips.

The overall operation of the attachment 10 will be given prior to the details of the various stations to set forth the environment of the stations. The attachment 10 is operated by starting the web 24 rotating through the various stations. When the film portion to be exposed reaches the charging station 14 it will be charged by a corona source either as it moves by the corona source or by stopping the web and moving the corona relative to the film portion. Once the film portion is charged the web is rotated until the film portion is located in the exposure station 16 where it is stopped and exposed by the camera system through the lens 12. The film portion is then rotated through the toning station 18 where toner is applied to the image which has been projected onto the film portion. The web 24 continues to rotate until it reaches the transfer station 20 where the toned image is transferred from the film portion onto a blank lithographic printing plate which may be aluminum or other suitable material. The plate containing the toned image is then passed through the fixing station. Once the image has been transferred, the web 24 will continue its rotation through the cleaning station 22 where any remaining toner or other material will be cleaned from both sides of the web 24 and the web is then rotated completely around to the start position ready for the next imaging and transfer operation. The cleaning station 22 is optional, because the operation of the attachment 10 to a blank printing plate under the proper conditions would remove all the toner from the film portion leaving the film portion ready to be recycled for the next imaging operation without the intervening cleaning step.

The components of the various stations and the detailed operations thereof will now be set forth. The charging station 14 includes a corona voltage source 28 which contains a corona wire or wires 30. The corona voltage source 28 may be fixed to charge the film portion as it passes over the corona source and wire 30 or it may oscillate to provide an even distribution of charge on the film portion. The film portion as utilized hereinafter is that portion of the web 24 which is chosen to be exposed in the exposure station 16. The film portion may also be stopped and the corona source 28 may be moved across the film portion to provide the even distribution of charge on the film portion. The corona source 28 will preferably be operated at a voltage of approximately 6,000 volts.

Once the film portion is charged to $8\times10^{-7}$ coulombs/cm$^2$ or 30 volts equivalent the charged film portion is moved into the exposure station 16. The exposure station 16 includes an exposure platen 32 which is disposed above the web 24 with a lower smooth planar surface 34 disposed below the untensioned plane of the web 24 between the rollers 36 and 38. Surface 34 may be beveled at each end to facilitate the passage of the web thereover and the surface will be located in the image plane of the camera system and lens 12. Thus, the web 24 will be drawn tightly and smoothly across the bottom surface 34 so that a smooth unwrinkled surface will be presented to the camera system and lens 12. To further facilitate the passage of the web 24 past the platen 32, the platen 32 is preferably provided with a series of passageways (not shown) disposed across and opening to the bottom surface 34 which are connected to a source of positive fluid pressure (not shown). The pressure source is energized when the belt 24 is moving, but is deenergized when the belt is stopped in the exposure station 16 so that the film 24 will be drawn against the smooth platen surface 34.

Figure 8:
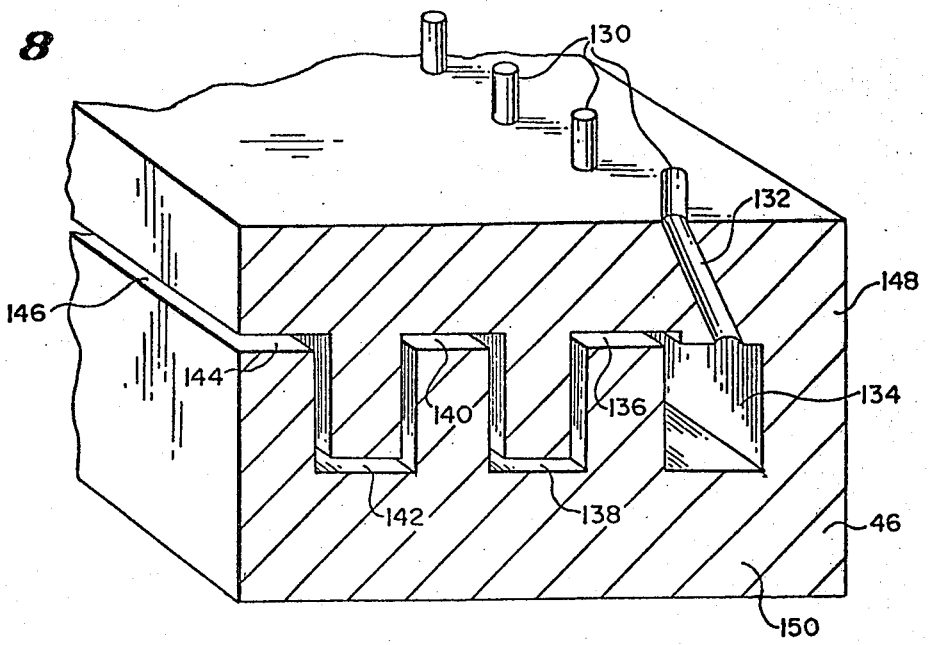
FIG. 8 is a side sectional view of a toning manifold which may be used with the attachment.

Once the film portion has been exposed it is rotated over the ohmic roller 38 and across the direction rolls 40 and 42 in the toning station 18. The web 24 is tensioned between the direction rolls 40 and 42 to form a smooth planar reach with a gap between the film portion and a toning platen 44. Toner in liquid or dry form is applied in the gap. Preferably, the toner is in liquid form and is supplied through at least one of a pair of manifolds 46 and 48 (FIG. 8). Preferably the manifold 46 is used in conjunction with the manifold 48 to form a smooth nonturbulent flow of toner in the gap formed between the toning platen 44 and film portion. A toning bias, preferably, is electrically applied between the toning platen 44 and the web 24 to assist in the toner particles adhering to an image on the film portion.

The toning platen 44 has an upper generally planar surface 50 between the rolls 40 and 42 to maintain the gap between the film portion and the toning platen. An upper shoe 51 may be utilized which has a bottom planar surface 52 disposed parallel to the surface 50. The surface 52 keeps the film portion planar between the rolls 40 and 42 to precisely maintain the gap. The toning bias may be in a range of negative 5–25 volts, preferably about 11 volts. The gap may be in a range of 5 to 40 mils, preferably about 12 mils. The upper surface 50 of the toning platen 44 is smoothly polished so that the toning particles and fluid will flow smoothly over the surface thereof and not become adhered to any particular portion thereof.

Any excess toner is removed from the film portion by an extraction roller 53 as the film portion passes by the extraction roller. The extraction roller 53 is spaced from the web 24 which space may be less than 6 mils, preferably about 4 mils, and it is electrically biased to withdraw the toner particles which are not firmly adhered to the imaged portion of the film. The bias may be in a range of negative 20–250 volts, preferably about 135 volts. The toner particles and liquid are removed from the extraction roller 53 by a squeegee 54. The toner which is not utilized and the fresh toner are captured in a tray or reservoir 56 which is located beneath the other components of the toning station 18.

To assist in the extraction of the excess toner particles from the film portion a spray bar 58 is located above the extraction roller 53 and will spray a film of toner into the gap between the web 24 and the extraction roller 53 to provide a medium for the toner particles and the electric field between the extraction roller and the film to allow the excess toner particles to be removed.

The web and film portion continue rotating from the toner station 18 over a guide or direction roller 60 to the transfer station 20. The transfer station is preferably loaded with a blank printing plate 62 prior to the start of the operation of the attachment. The plate 62 is loaded into a first chute 64 which directs the plate past a tangent point of the web 24 but spaced therefrom. The web 24 passes over another roller 66 in the transfer station 20 which locates the web and the film portion as it passes through the transfer station. A freely rotatable transfer roller 68 is disposed for pivotal movement away from and in close proximity to the web 24 such as on a pivot arm 70. The plate 62 such as a sheet of aluminum extends between the two rollers 66 and 68, but is not in contact with the web 24. After passing through rollers 66 and 68, the plate 62 will pass through fixing station 23 and then into a discharge chute 72 to precisely locate the medium 62. When the front edge of the imaged portion arrives in the transfer station 20, the transfer roller 68 is pivoted against the plate 62 to bring it into close proximity with the web 24 to transfer the image to the medium 62 which will rotate with the rotating belt 24 between the rollers 66 and 68. A transfer bias may be applied between the roller 68 and the web 24 and may be in the range of negative 250–1200 volts. The transfer bias should be just sufficient to fully transfer any toned image and will preferably be about negative 500 volts. The roller 68 may bring the medium 62 directly against the film portion or may leave a slight gap to avoid mechanical smearing of the image if the medium 62 will not absorb the fluid surrounding the toner particles on the film portion. The gap may be in the range of 0–4 microns.

The web 24 then moves on into the cleaning station 22 where it passes around another roller 74 and past a foam cleaning brush 76 which dislodges any firmly attached toner particles or other material which have not been removed by the transfer operation. The web 24 then passes past a cleaning spray bar 78 which sprays a cleaning fluid against the film which is squeegeed by an air brush or knife 80 which provides a smooth flow of air across the width of the film and may contain a fluid baffle such as 46 or 48. The nozzle of the air brush 80 is coated with a non-abrasive material; however, the web and film portion thereof preferably will not touch the air brush due to the flow of the air from the nozzle. The cleaning solution and excess toner particles are caught in a reservoir 82 located at the bottom of the cleaning station 22. The back or inside of the web 24 is cleaned by a squeegee 84 as it passes the adjustable ohmic guide roller 36. The ohmic roller 36 has an adjustment at each end 86, one of which is shown, to steer the web around the sets of rollers in the attachment 10 without excessive lateral movement thereof. The web 24 then continues through the other stations without their being energized and returns to the initial or stop position ready for another cycle. As previously mentioned with the proper biasing, toning and transfer conditions cleaning station 22 may be eliminated.

Figure 3:
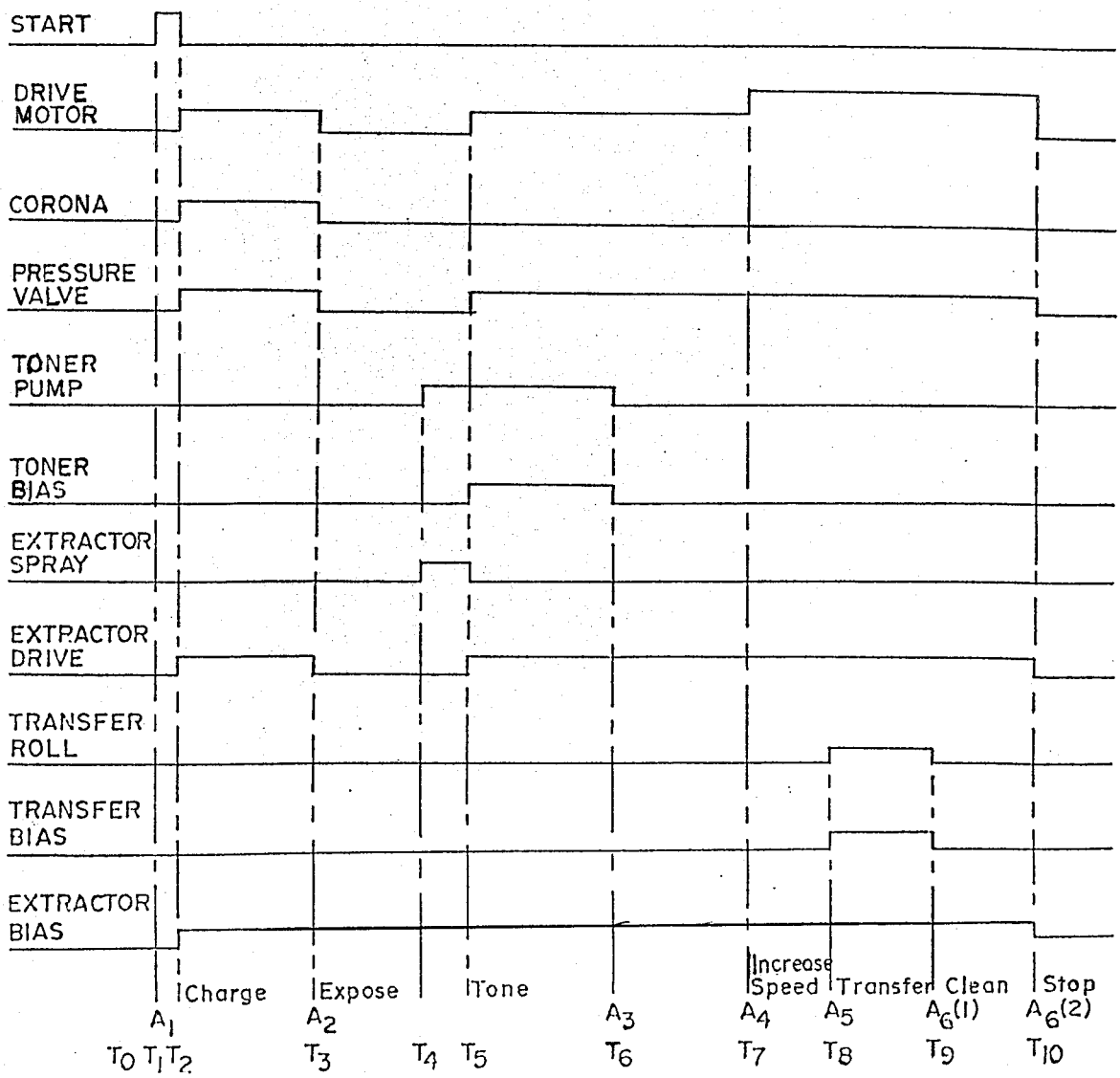
FIG. 3 is a timing diagram illustrative of the operation of the attachment.

Referring now to FIG. 3, a timing diagram for the attachment 10 is illustrated; however, it should be noted that the time factor between each of the times $T_0$ through $T_{10}$ is not drawn to scale and these will vary as determined by a particular operation, size of components, etc. The operation will be explained with the timing diagram utilizing the sensors $A_1$ through $A_6$ which sense the metallic strips 26 and 27 along the peripheries of the web 24.

At time $T_0$ the start mechanism is energized which will activate a drive motor 88 starting the web rotating, energizing the pressure valve in the exposure platen 32, rotating the extractor roll 53 and applying the bias to the extractor roll. At time $T_2$, upon sensing the strip 26 by the sensor $A_1$, the corona voltage source 28 will be energized and the charge will be applied to the film portion until time $T_3$ when the strip 26 is sensed by the sensor $A_2$. At time $T_3$ the drive motor will stop, the corona voltage source will deenergize, the pressure valve and the exposure platen 32 will deenergize, drawing the film against the platen surface 34. The extractor roll 53 will also stop rotating as it is geared to the drive motor 88; however, it could be kept rotating by a separate drive if desired. The film portion is then exposed by the camera through the lens 12 by opening a shutter within the camera to project a light image onto the film.

At time $T_4$, prior to the end of the exposure and the restart of the rotation of the web 24, the toner pump (not shown) will be operated to flow toner through the manifolds 46 and 48 and the extractor spray will be operated to fill the gap between the extraction roll 53 and the web 24 with toner so that the extraction roll will be operating properly. At time $T_5$ when the film portion has been properly exposed, an elapsed time of 1–10 seconds, the drive motor 88, the pressure valve in the platen 32, the toner bias on the platen 44 and the extractor drive are actuated. The film portion then moves through the toner station 18 and is sensed by the sensor $A_3$ at time $T_6$ indicating that the film portion has passed through the toning station. This will deactuate the toner pump and toner bias and the film portion will be transported onto the transfer station 20 during the time period from $T_6$ to time $T_7$.

At time $T_7$ when the strip 26 is sensed by the sensor $A_4$ the drive motor 88 will increase its speed for the transfer operation as it has been found that the toning operation is more successful at a lower speed than the transfer operation. The web 24 may move through the toning station at approximately 5 inches/second and may be transferred at a speed of approximately 8 inches/second. As the front edge of the film portion moves into the transfer station 20 the strip 27 is sensed by the sensor $A_5$ at time $T_8$ which actuates the bias on the transfer roller 68 at the same time it is actuated to move against the medium 62 and press it into close proximity with the belt 24 to pass the medium 62 intimately against the film portion of the web 24 as it passes between the two rollers 66 and 68. The first time that the strip 26 is sensed by the sensor $A_6$ at time $T_9$ it energizes the components of the cleaning station 22 and the web 24 then rotates through each of the stations to clean off any residual material from the belt. When the sensor $A_6$ senses the strip 26 a second time at time $T_{10}$ all the systems and stations are deactivated and the web 24 is stopped ready for the next imaging and transfer operation.

Figure 4:
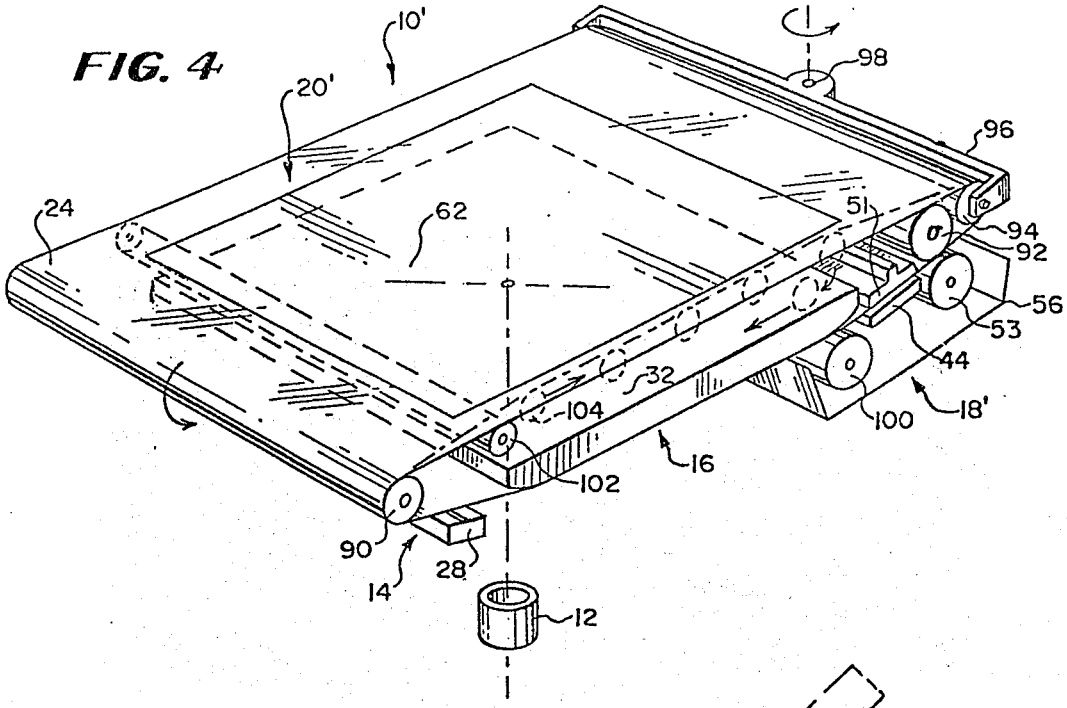
FIG. 4 is a perspective diagram of a second embodiment of the attachment.
Figure 5:
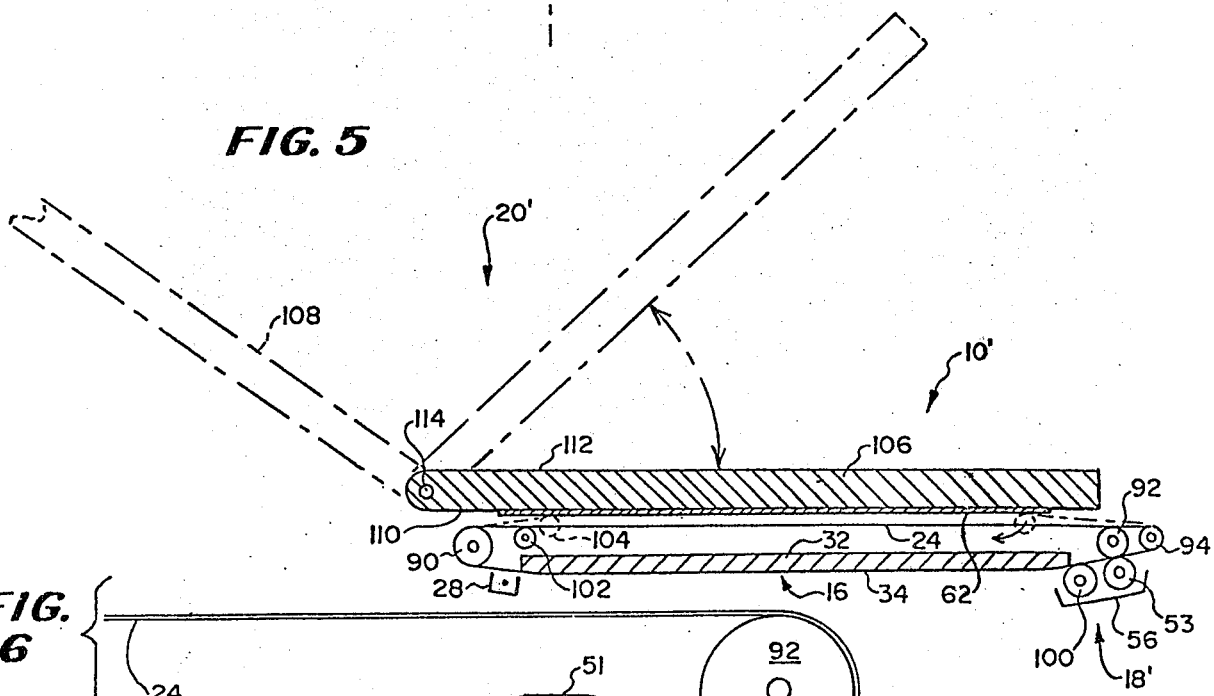
FIG. 5 is a diagram of the embodiment of FIG. 4 showing a second type of transfer mechanism.

Referring now to FIGS. 4 and 5, a second embodiment of the attachment 10' is illustrated. In this embodiment, the charging station 14 and the exposure station 16 remain the same as described previously; however, the cleaning station 22 has been eliminated and a different toning station 18' and transfer station 20' are utilized. The basic operation, with the exception of the cleaning operation, remains the same as described previously. The various rollers of FIGS. 1 and 2 have been replaced by two main support rollers 90 and 92, one or both of which are engaged with the motor to frictionally rotate the belt 24 as before. A third adjustable steering roller 94 is inserted in one end of the belt 24 to assure proper alignment of the belt in a like manner as the adjustable roller 36. The roller 94 is connected to a swivel bar 96 which is secured to adjustably pivot around a center point 98 to properly adjust the tracking of the web 24. The center point 98 could of course be replaced by two or more adjustable points on the outer ends of the swivel bar 96 as described before.

The film portion on the web 24 is again charged and exposed as before; however, the toner is applied by a rotating toner feed roll 100 which adhesively picks up the toner from the toner tray or reservoir 56 and applies the toner in a smooth uniform manner across the width of the film portion of the web 24. As previously mentioned, the toning platen 44 and the upper shoe 51 may be provided to maintain the optimum gap between the web 24 and the toning platen 44. The toner stations 18 and 18′ are, of course, interchangeable as desired.

Once the film portion has been toned it continues around the roller 94 to the transfer station 20′. In this embodiment the film portion would be rotated until the front edge of the portion is located toward the end of the transfer station 20′. The web 24 is then stopped and the medium 62 is then brought into close proximity with the web 24 for the transfer operation. The film portion of the web 24 is brought into close proximity with the medium 62 by a reciprocating transfer roller 102 which is disposed parallel to and below the web 24.

Referring to the timing diagram of FIG. 3, the sensors $A_4$ and $A_5$ would be replaced by a single sensor and the time $T_7$ and $T_8$ would coincide and the drive motor 88 would stop, stopping the rotation of the web and the transfer bias would be applied to the medium 62, not to the roller 102. The roller 102 would be activated and move the roller into position 104 illustrated in phantom to reciprocate the roller 102 across the film portion, sequentially bringing the film portion of the web 24 into close proximity or contact with the plate 62 across the entire length thereof. The roller 102 would then be returned to its initial position away from the web 24.

One convenient method of locating plate 62 parallel to the upper reach of the web 24 is a vacuum platen 106. The vacuum platen 106 has a first open or load position 108 which exposes a bottom planar surface 110 having the vacuum or other negative fluid passageways (not shown) opening thereto. The plate 62 is placed onto the platen 106 in the load position 108 and then the vacuum source (not shown) is operated to clamp the plate 62 to the platen 106 which is then pivoted or otherwise moved to the transfer or receiving position 112. The platen 106 may contain other means to affix the plate 62 to the surface 110 and may be conveniently moved between the open position 108 and the receiving position 112 by pivoting it around a pivot 114. The transfer bias would be applied to the platen 106 and when the transfer roller 102 has returned to its start position at time $T_9$ the platen 106 would move from its receiving position 112 to its load and unload position 108 and the cycle would be stopped ready for the new medium 62 to be loaded in and the next image and transfer operation to take place.

Figure 6:
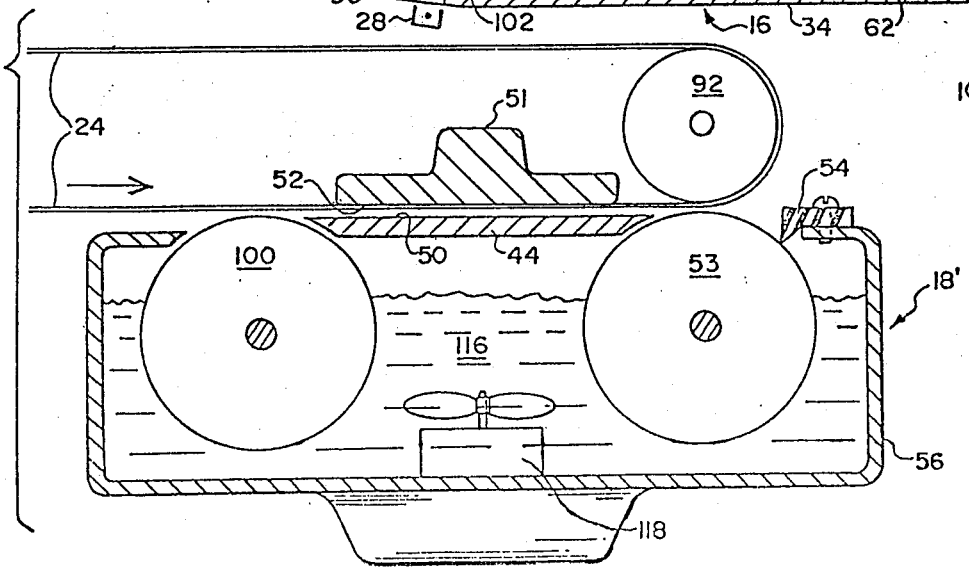
FIG. 6 is an enlarged diagram of the toner station of FIG. 4.

The toning station 18′ is best illustrated in FIG. 6. The toner feed roll 100 rotates with its bottom surface submerged in the toner fluid 116 which is kept agitated by a submerged toner agitator 118 to keep the toner particles from settling to the bottom of the tray or reservoir 45. The top of the toner feed roll is positioned approximately 5 to 10 microns from the bottom surface of the web 24. The toner particles adhere to the periphery of the roll 100 as it rotates through the fluid 116 and are attracted in the upper position to the film portion of the web 24. The excess toner fluid will be removed from the web 24 when it exits from the toning platen 44 by the extractor roll 53 which is kept clean by the squeegee 54. The gap between the surfaces 50 and 52 is also more clearly illustrated and is preferably on the order of 5–40 mils with the extraction roll gap being approximately 4 to 6 mils.

Figure 7:
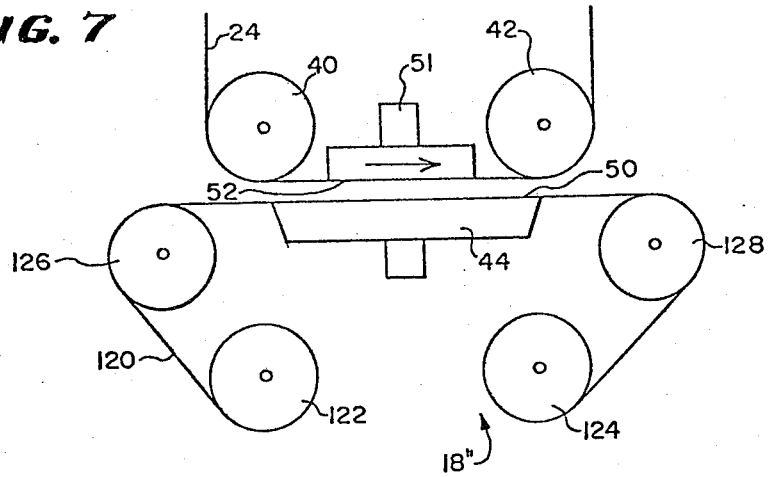
FIG. 7 is a diagram of another embodiment of the toner station to be used with the attachment.

FIG. 7 illustrates a third embodiment of the toning station 18″. In this embodiment a flexible sheet 120 is connected to a pair of drive rolls 122 and 124. The rolls 122 and 124 are driven in tandem to rotate the sheet from the roll 122 around a pair of guide rollers 126 and 128 onto the second drive roll 124 to apply toner to the film portion as it passes through the toning station 18″. The toning platen 44, upper shoe 51 and the directional rolls 40 and 42 have been shown merely as illustrations and the flexible sheet 120 or window shade type toning station may also be used with the embodiment as shown in FIG. 4 with or without the toning platen 44 and the upper shoe 51, depending on the tensioning and positioning of the web 24. Once the film has passed through the toning station 18″ the drive rolls 122 and 124 reverse and rewind the flexible sheet or window shade 120 onto the roll 122. The toner may be picked up by the sheet as it unwinds from the roll 122 or may be applied by a manifold like the manifold 46 of FIGS. 1 and 2 after it has passed over the roll 126.

The design of the toning manifolds 46 and 48 and the air knife or air brush 80 is most clearly illustrated in FIG. 8, where the manifold 46 is shown in section. The fluid air or toner is applied by a pump to one or a number of ports 130 connected to a plurality of passageways 132 which direct the fluid into a first chamber 134. The chamber 134 as well as each of the succeeding chambers and baffles extends the width of the manifold which is of a width substantially equal to the imaged film portion of the web 24. When the fluid has filled the first chamber 134 it will flow through a narrow passageway 136 into the second chamber 138 in a serpentine fashion and from the chamber 138 through a passageway 140 into a third chamber 142 and in a like manner from the third chamber 142 through a confining passage 144 to an exit or nozzle slit 146 in a smooth nonturbulent even flow across the width of the nozzle 146 assuring a substantially constant even flow of toner across the width of the web 24. The manifold 46 may be formed from a single block or may be formed from an upper block portion 148 mated with a lower block portion 150 to form the passageways and chambers therebetween.

The toner preferably will not be applied across the entire width of the web 24 so that the back of the web will remain dry for the motor 88 to frictionally drive the web through one or more of the rolls. Preferably the roll 74 will be driven as the web 24 makes a 180° wraparound this roll. Each of the rolls is preferably made of metal to secure the proper dimension and to make ohmic contact through the rolls 36 and 38.

Many modifications and variations of the present invention are possible in the light of the above teachings. It is therefore to be understood that within the scope of the appended claims the invention may be practiced otherwise than as specifically described.

What is claimed and desired to be secured by Letters Patent of the United States is:

1. An attachment for a graphic arts camera for use in making a lithographic printing plate electrophotographically comprising:

rotatable endless web means including at least an electrophotographic surface portion, said web and electrophotographic surface portion including a front or exposure side and a back side;

drive means for rotating said web sequentially through a set of stations;

said set of stations including;

a charging station located adjacent said exposure side including corona means for charging said electrophotographic surface portion while it is in said charging station;

an exposure station following said charging station including planar platen means having a surface uniformly exactly in the image plane of the camera for accommodating the exposure side of the electrophotographic surface thereon to position and to hold said portion exactly in the image plane of the camera for exposure, sensing means for locating and stopping said electrophotographic surface portion against said platen means surface exactly in said image plane, and positive pressure fluid means at said exposure station operable to release said electrophotographic surface portion from the image plane upon completion of exposure whereby to facilitate passage of the web past said platen means;

a toning station immediately following said exposure station including means for applying a substantially constant amount of toner in a smooth and nonturbulent flow across the width of only said exposure side of the electrophotographic surface portion as it is moved through said toning station; and a transfer station following said toning station including means for transferring an image from said exposure side of the electrophotographic surface portion onto a blank lithographic printing plate, including means for moving said transfer medium and said exposure side of the electrophotographic surface portion into close proximity during said transfer.

2. An attachment as claimed in claim 1 further including:

a cleaning station following said transfer station including means for cleaning an excess toner or other material from said web and said electrophotographic surface portion.

3. An attachment as claimed in claim 1 wherein said transfer station includes:

transfer bias means for electrically biasing said electrophotographic surface portion relative to said transfer medium to assist in the transfer operation.

4. An attachment as claimed in claim 1 wherein said toning station includes:

liquid toner supply means and means for applying toner in a smooth and nonturbulent flow to said front side of said electrophotographic surface portion, said means for applying said liquid toner including a toning platen including a smooth substantially planar surface spaced from said front side, and said liquid toner supply means include at least first manifold means having at least a first longitudinal baffle connected to a longitudinal exit for flowing said toner onto said electrophotographic surface portion.

5. An attachment as claimed in claim 4 wherein said toning station includes:

shoe means including a smooth substantially planar surface disposed against said back side, substantially parallel to said toning platen means planar surface to form a predetermined constant gap between said electrophotographic surface portion and said toning platen.

6. An attachment as claimed in claim 4 wherein said toning station includes:

bias means for electrically biasing said electrophotographic surface portion relative to said toning platen across said gap to assist in the toning operation.

7. An attachment as claimed in claim 1 wherein said toning station includes:

toner feed roll means disposed substantially parallel to and adjacent to said front side for feeding toner to said electrophotographic surface portion; and toning platen means adjacent said feed roll means including a substantially smooth surface spaced from said front side.

8. An attachment as claimed in claim 7 wherein said toning station includes:

bias means for electrically biasing said electrophotographic surface portion relative to said toning platen means across the space between them to assist in the toning operation.

9. An attachment as claimed in claim 7 wherein said toning station includes:

shoe means including a smooth substantially planar surface disposed against said back side, substantially parallel to said toning platen means planar surface to form a predetermined gap between said electrophotographic surface portion and said toning platen means.

10. An attachment as claimed in claim 1 wherein said toning station includes:

toning curtain means including a flexible sheet having a first reach disposed substantially parallel to said front side of said electrophotographic surface portion to form a gap therebetween as it passes through said toning station, and including means rotating said sheet from a toner supply past said front side of said electrophotographic surface portion to supply toner to said electrophotographic surface portion.

11. An attachment as claimed in claim 10 wherein said toning station includes:

bias means for electrically biasing said electrophotographic surface portion relative to said toning platen means across said gap to assist in the toning operation.

12. An attachment as claimed in claim 10 wherein said toning station includes:

toning platen means including a smooth substantially planar surface disposed against said flexible sheet in said first reach on the side opposite of said electrophotographic surface portion to maintain said gap.

13. An attachment as claimed in claim 12 wherein said toning station includes:

shoe means including a smooth substantially planar surface disposed against said back side, substantially parallel to said toning platen means planar surface to maintain said gap.

14. An attachment as claimed in claim 1 wherein said transfer station includes:

support roll means disposed against said back side for supporting and positioning said web and electrophotographic surface portion as it passes through said transfer station:

chute means for feeding said transfer medium adjacent to but spaced from said web on said front side; and transfer roll means opposite said support roll means being operative by said moving means to press against said medium to move it into close proximity with said electrophotographic surface portion for transferring an image to said transfer medium as it passes through said transfer station between said rolls.

15. An attachment as claimed in claim 14 wherein said transfer station includes:

transfer bias means for electrically biasing said electrophotographic surface portion relative to said transfer medium and said transfer roll means to assist in the transfer operation.

16. An attachment as claimed in claim 1 wherein said transfer station includes:

loading platen means having a substantially planar surface including means for holding said transfer medium against said planar surface;

said moving means including means for moving said loading platen means surface from a first load and unload position away from said web, to a second transfer position close to but spaced from and substantially parallel to said front side of said web; and roller means disposed adjacent said back side spaced for movement against said back side of said web parallel to said platen means surface to bring said electrophotographic surface portion into close proximity with said transfer medium for transferring an image to said medium.

17. An attachment as claimed in claim 16 wherein said transfer station includes:

transfer bias means for electrically biasing said electrophotographic surface portion relative to said transfer medium and said platen means to assist in the transfer operation.

18. An attachment for a graphic arts camera for use in making a lithographic printing plate electrophotographically comprising:

rotatable endless web means including at least an electrophotographic surface portion, said web and electrophotographic surface portion including a front or exposure side and a back side;

drive means for rotating said web sequentially through a set of stations;

said set of stations including;

a charging station located adjacent said front side including corona means for charging said electrophotographic surface portion while it is in said charging station;

an exposure station following said charging station including means for positioning said electrophotographic film surface portion exactly in the image plane of the camera for exposure;

a toning station immediately following said exposure station including means for applying a substantially constant amount of toner across the width of only said front side of said electrophotographic surface portion as it is moved through said toner station, said toner station including liquid toner supply means and means for applying toner in a smooth and nonturbulent flow to said front side of said electrophotographic portion;

said means for applying said liquid toner including a toning platen having a smooth substantially planar surface spaced from said front side, and said liquid toner supply means include at least first manifold means having at least a first longitudinal baffle connected to a longitudinal exit for flowing said toner onto said surface portion; and a transfer station following said toning station including means for transferring an image from said front side of the electrophotographic surface portion onto a blank lithographic printing plate, including means for moving said transfer medium and said front side of the electrophotographic surface portion into close proximity during said transfer.

19. An attachment as claimed in claim 18 wherein said toning station includes:

shoe means including a smooth substantially planar surface disposed against said back side, substantially parallel to said toning platen means planar surface to form a predetermined constant gap between said electrophotographic surface portion and said toning platen.

20. An attachment as claimed in claim 18 wherein said toning station includes:

bias means for electrically biasing said electrophotographic surface portion relative to said toning platen across said gap to assist in the toning operation.

21. An attachment for a graphic arts camera for use in making a lithographic printing plate electrophotographically comprising:

rotatable endless web means including at least an electrophotographic surface portion, said web and electrophotographic surface portion including a front or exposure side and a back side;

drive means for rotating said web sequentially through a set of stations;

said set of stations including;

a charging station located adjacent said front side including corona means for charging said electrophotographic surface portion while it is in said charging station;

an exposure station following said charging station including platen means disposed opposite said back side having a substantially planar surface positioned in said exposure plane and lying below the untensioned plane of said web to press said surface portion smoothly against said planar surface to position said surface portion exactly in the image plane of the camera for exposure, means forceably releasing the surface portion from said platen means;

a toning station immediately following said exposure station including means for applying a substantially constant amount of toner across the width of only said front side of the electrophotographic surface portion as it is moved through said toning station; and a transfer station following said toning station including means for transferring an image from said front side of the electrophotographic surface portion onto a blank lithographic printing plate, including means for moving said transfer medium and said front side of the electrophotographic surface portion into close proximity during said transfer.

22. An attachment as claimed in claim 21 wherein said means forceably releasing the surface portion comprises:

positive pressure fluid means associated with said platen means and disposed across said planar surface operable when said web is moving to facilitate the passage of said web through said exposure station past said platen surface.

23. An attachment for a graphic arts camera for use in making a lithographic printing plate electrophotographically comprising:

rotatable endless web means including at least an electrophotographic surface portion, said web and electrophotographic surface portion including a front or exposure side and a back side;

drive means for rotating said web sequentially through a set of stations;

said set of stations including;

a charging station located adjacent said front side including corona means for charging said electrophotographic surface portion while it is in said charging station;

an exposure station following said charging station including means for positioning said electrophotographic surface portion exactly in the image plane of the camera for exposure;

a toning station immediately following said exposure station including means for applying a substantially constant amount of toner across the width of only said electrophotographic surface portion as it is moved through said toning station, said toning station including toner feed roll means disposed substantially parallel to and adjacent to said front side for feeding toner to said electrophotographic surface portion; and toning platen means adjacent said feed roll means including a substantially smooth surface spaced from said front side; and a transfer station following said toning station including means for transferring an image from said electrophotographic surface portion onto a blank lithographic printing plate, including means for moving said transfer medium and said front side of said electrophotographic surface portion into close proximity during said transfer.

24. An attachment as claimed in claim 23 wherein said toner station includes:

bias means for electrically biasing said electrophotographic surface portion relative to said toning platen means across the space between them to assist in the toning operation.

25. An attachment as claimed in claim 23 wherein said toning station includes:

shoe means including a smooth substantially planar surface disposed against said back side, substantially parallel to said toning platen means planar surface to form a predetermined gap between said electrophotographic surface portion and said toning platen means.

26. An attachment for a graphic arts camera for use in making a lithographic printing plate electrophotographically comprising:

rotatable endless web means including at least an electrophotographic surface portion, said web and electrophotographic surface portion including a front or exposure side and a back side;

drive means for rotating said web sequentially through a set of stations;

said stations including;

a charging station located adjacent said front side including corona means for charging said electrophotographic surface portion while it is in said charging station;

an exposure station following said charging station including means for positioning said electrophotographic surface portion exactly in the image plane of the camera for exposure;

a toning station immediately following said exposure station including means for applying a substantially constant amount of toner across the width of only said front side of said electrophotographic surface portion as it is moved through said toning station; said toning station including toning curtain means including a flexible sheet having a first reach disposed substantially parallel to said front side of said electrophotographic surface portion to form a gap therebetween as it passes through said toning station, and including means rotating said sheet from a toner supply past said front side of said electrophotographic surface portion to supply toner to said electrophotographic surface portion; and a transfer station following said toning station including means for transferring an image from said electrophotographic surface portion onto a blank lithographic printing plate, including means for moving said transfer medium and said front side of said electrophotographic surface portion into close proximity during said transfer.

27. An attachment as claimed in claim 11 wherein said toning station includes:

bias means for electrically biasing said electrophotographic surface portion relative to said toning platen means across said gap to assist in the toning operation.

28. An attachment as claimed in claim 26 wherein said toning station includes:

toning platen means including a smooth substantially planar surface disposed against said flexible sheet in said first reach on the side opposite of said electrophotographic surface portion to maintain said gap.

29. An attachment as claimed in claim 28 wherein said toning station includes:

shoe means including a smooth substantially planar surface disposed against said back side, substantially parallel to said toning platen means planar surface to maintain said gap.

30. An attachment for a graphic arts camera for use in making a lithographic printing plate electrophotographically comprising:

rotatable endless web means including at least an electrophotographic surface portion, said web and electrophotographic portion including a front or exposure side and a back side:

drive means for rotating said web sequentially through a set of stations;

said set of stations including;

a charging station located adjacent said front side including corona means for charging said electrophotographic surface portion while it is in said charging station;

an exposure station following said charging station including means for positioning said electrophotographic surface portion exactly in the image plane of the camera for exposure;

a toning station immediately following said exposure station including means for applying a substantially constant amount of toner across the width of only said electrophotographic surface portion as it is moved through said toning station;

a transfer station following said toning station including means for transferring an image from said electrophotographic surface portion onto a blank lithographic printing plate, including means for moving said transfer medium and said front side of said electrophotographic surface portion into close proximity during said transfer, and said transfer station includes support roll means disposed against said back side for supporting and positioning said web and electrophotographic surface portion as it passes through said transfer station; chute means for feeding said transfer medium adjacent to but spaced from said web on said front side; and transfer roll means opposite said support roll means being operative by said moving means to press against said medium to move it into close proximity with said electrophotographic surface portion for transferring an image to said transfer medium as it passes through said transfer station between said rolls.

31. An attachment as claimed in claim 30 wherein said transfer station includes:

transfer bias means for electrically biasing said electrophotographic surface portion relative to said transfer medium and said transfer roll means to assist in the transfer operation.

32. An attachment for a graphic arts camera for use in making a lithographic printing plate electrophotographically comprising:

rotatable endless web means including at least an electrophotographic surface portion, said web and electrophotographic portion including a front or exposure side and a back side;

drive means for rotating said web sequentially through a set of stations;

said set of stations including;

a charging station located adjacent said front side including corona means for charging said electrophotographic surface portion while it is in said charging station;

an exposure station following said charging station including means for positioning said electrophotographic surface portion exactly in the image plane of the camera for exposure;

a toning station immediately following said exposure station including means for applying a substantially constant amount of toner across the width of only said electrophotographic surface portion as it is moved through said toning station;

a transfer station following said toning station including means for transferring an image from said electrophotographic surface portion onto a blank lithographic printing plate, including means for moving said transfer medium and said front side of said electrophotographic surface portion into close proximity during said transfer, and said transfer station includes loading platen means having a substantially planar surface including means for holding said transfer medium against said planar surface; said moving means including means for moving said loading platen means surface from a first load and unload position away from said web, to a second transfer position close to but spaced from and substantially parallel to said front side of said web; and roller means disposed adjacent said back side spaced for movement against said back side of said web parallel to said platen means surface to bring said electrophotographic surface portion into close proximity with said transfer medium for transferring an image to said medium.

33. An attachment as claimed in claim 32 wherein said transfer station includes:

transfer bias means for electrically biasing said electrophotographic surface portion relative to said transfer medium and said platen means to assist in the transfer operation.

34. An attachment for use with a graphic arts camera that has a lens system for projecting a light image to an image plane for use in making a lithographic printing plate electrophotographically comprising:

roller mounted rotatable endless web means including at least a surface portion having electrophotographic properties, said web and electrophotographic surface portion including a front or exposure side and a back side:

drive means for rotating said web sequentially through a set of stations;

said set of stations including;

a charging station located adjacent said exposure side including corona means for charging said electrophotographic surface portion while it is in said charging station;

an exposure station following said charging station including planar platen means having a surface uniformly exactly in the image plane for accommodating the electrophotographic portion therein for locating and stopping said film portion exactly in said image plane for exposure by said lens system to produce a latent image on said electrophotographic surface portion and positive fluid pressure means operable to release said electrophotographic surface upon completion of exposure for movement thereof to the next station;

a toning station following said exposure station including means for applying a substantially constant amount of an ink-receptive toner in a smooth and nonturbulent flow across the width of only said front side of said imaged surface portion as it is moved through said toning station to produce a toned image on said electrophotographic surface portion;

a transfer station following said toning station including means for transferring said toned image from said surface portion onto a blank lithographic printing plate, including means for moving said transfer medium and said front side of said toned surface portion into close proximity during said transfer; and a fixing station following the transfer station for fixing the toned transferred image to the lithographic printing plate.

35. An attachment for use with a graphic arts camera that has a lens system for projecting a light image to an image plane for use in making a lithographic printing plate electrophotographically comprising:

roller mounted rotatable endless web means including at least a portion of electrophotographic material, said web and electrophotographic portion including a front or exposure side and a back side;

drive means for rotating said web sequentially through a set of stations;

said set of stations including;

a charging station located adjacent said front side including corona means for charging said electrophotographic portion while it is in said charging station;

an exposure station following said charging station including means for locating and stopping said electrophotographic portion in said image plane for exposure by said lens system to produce a latent image on said electrophotographic surface portion;

a toning station following said exposure station including means for applying a substantially constantamount of an ink-receptive toner across the width of only said front side of said imaged electrophotographic portion as it is moved through said toning station to produce a toned image on said electrophotographic portion, said toning station including liquid toner supply means and means for applying liquid toner in a smooth and nonturbulent flow to said front side of said imaged electrophotographic portion, said means for applying including a toning platen including a smooth substantially planar surface spaced from said front side and a first manifold means having at least a first longitudinal baffle connected to a longitudinal exit for flowing said toner onto said imaged electrophotographic portion.

a transfer station following said toning station including means for transferring said toned image from said electrophotographic portion onto a blank lithographic printing plate, including means for moving said transfer medium and said front side of said toned electrophotographic portion into close proximity during said transfer; and a fixing station following the transfer station for fixing the toned transferred image to the lithographic printing plate.

36. An attachment as claimed in claim 35 wherein said toning station includes:

shoe means including a smooth substantially planar surface disposed against said back side, substantially parallel to said toning platen means planar surface to form a predetermined constant gap between said imaged electrophotographic portion and said toning platen means.

37. An attachment as claimed in claim 35 wherein said toning station includes:

bias means for electrically biasing said electrophotographic portion relative to said toning platen means across said gap to assist in the toning operation.

38. An attachment for use with a graphic arts camera that has a lens system for projecting a light image to an image plane for use in making a lithographic printing plate electrophotographically comprising:

roller mounted rotatable endless web means including at least a portion of electrophotographic properties including front or exposure side and a back side;

drive means for rotating said web sequentially through a set of stations;

said set of stations including;

a charging station located adjacent said front side including corona means for charging said electrophotographic portion while it is in said charging station;

an exposure station following said charging station including platen means for locating and stopping said electrophotographic portion in said image plane for exposure by said lens system to produce a latent image on said electrophotographic portion, said platen means being disposed opposite said back side and having a substantially planar surface, said planar surface positioned in said image plane and lying below the untensioned plane of said web to press said electrophotographic portion smoothly against said planar surface;

means forceably releasing the electrophotographic portion from said planar surface;

a toning station following said exposure station including means for applying a substantially constant amount of an ink-receptive toner across the width of only said front side of said imaged electrophotographic portion as it is moved though said toning station to produce a toned image on said electrophotographic portion;

a transfer station following said toning station including means for transferring said toned image from said electrophotographic portion onto a blank lithographic printing plate, including means for moving said transfer medium and said front side of said toned electrophotographic portion into close proximity during said transfer; and a fixing station following the transfer station for fixing the toned transferred image to the lithographic printing plate.

39. An attachment as claimed in claim 38 wherein said platen means include:

positive pressure fluid means disposed across said planar surface operable when said web is moving fo facilitate the passage of said web through said exposure station past said platen surface.

40. An attachment as claimed in claim 38 further including:

a cleaning station following said transfer station including means for cleaning any excess toner or other material from said web and said electrophotographic portion.

41. An attachment as claimed in claim 38 wherein said transfer station includes:

transfer bias means for electrically biasing said toned electrophotographic portion relative to said transfer medium to assist in the transfer operation.

42. An attachment as claimed in claim 38 in which said means forceably releasing said surface portion comprises a source of pressurized fluid and means associated with said plate means for applying said fluid under pressure to said surface portion from the undersurface thereof.

43. An attachment as claimed in claim 38 wherein said forcing means comprise a source of fluid pressure and means to dispense fluid pressure against said web to force said exposed surface portion away from said planar surface.

44. An attachment for use with a graphic arts camera that has a lens system for projecting a light image to an image plane for use in making a lithographic printing plate electrophotographically comprising:

roller mounted rotatable endless web means including at least a portion of electrophotographic properties including a front or exposure side and a back side;

drive means for rotating said web sequentially through a set of stations;

said set of stations including:

a charging station located adjacent said front side including corona means for charging said electrophotographic portion while it is in said charging station;

an exposure station following said charging station including means for locating and stopping said electrophotographic portion in said image plane for exposure by said lens system to produce a latent image on said electrophotographic portion;

a toning station following said exposure station including means for applying a substantially constant amount of an ink-respective toner across the width of only said front side of said imaged electrophotographic portion as it is moved through said toning station to produce a toned image on said electrophotographic portion, said toning station including toner feed roll means disposed substantially parallel to and adjacent to said front side for feeding toner to said imaged electrophotographic portion; and toning platen means adjacent said feed roll means including a smooth substantially planar surface spaced from said front side, a transfer station following said toning station including means for transferring said toned image from said electrophotographic portion onto a blank lithographic printing plate, including means for moving said transfer medium and said front side of said toned electrophotographic portion into close proximity during said transfer; and a fixing station following the transfer station for fixing the toned transferred image to the lithographic printing plate.

45. An attachment as claimed in claim 44 wherein said toner station includes:

bias means for electrically biasing said imaged electrophotographic portion relative to said toning platen means across the space between them to assist in the toning operation.

46. An attachment as claimed in claim 44 wherein said toning station includes:

shoe means including a smooth substantially planar surface disposed against said back side, substantially parallel to said toning platen means planar surface to form a predetermined gap between said imaged electrophotographic portion and said toning platen means.

47. An attachment for use with a graphic arts camera that has a lens system for projecting a light image to an image plane for use in making a lithographic printing plate electrophotographically comprising:

roller mounted rotatable endless web means including at least a portion of electrophotographic properties including a front or exposure side and a back side;

drive means for rotating said web sequentially through a set of stations;

said set of stations including:

a charging station located adjacent said front side including corona means for charging said electrophotographic portion while it is in said charging station;

an exposure station following said charging station including means for locating and stopping said electrophotographic portion in said image plane for exposure by said lens system to produce a latent image on said electrophotographic portion;

a toning station following said exposure station including means for applying a substantially constant amount of an ink-receptive toner across the width of only said front side of of said imaged electrophotographic portion as it is moved through said toning station to produce a toned image on said electrophotographic portion, said toning station including toning curtain means including a flexible sheet having a first reach disposed substantially parallel to said front side of said imaged electrophotographic portion to form a gap therebetween as it passes through said toning station, and including means rotating said sheet from a toner supply past said front side of the said electrophotographic portion to supply toner to said imaged portion;

a transfer station following said toning station including means for transferring said toned image from said electrophotographic portion onto a blank lithographic printing plate, including means for moving said transfer medium and said front side of said toned electrophotographic portion into close proximity during said transfer; and a fixing station following the transfer station for fixing the toned transferred image to the lithographic printing plate.

48. An attachment as claimed in claim 47 wherein said toning station includes:

bias means for electrically biasing said imaged electrophotographic portion relative to said toning platen means across said gap to assist in the toning operation.

49. An attachment as claimed in claim 47 wherein said toning station includes:

toning platen means including a smooth substantially planar surface disposed against said flexible sheet in said first reach on the side opposite of said electrophotographic portion to maintain said gap.

50. An attachment as claimed in claim 49 wherein said toning station includes:

shoe means including a smooth substantially planar surface disposed against said back side, substantially parallel to said toning platen means planar surface to maintain said gap.

51. An attachment for use with a graphic arts camera that has a lens system for projecting a light image to an image plane for use in making a lithographic printing plate electrophotographically comprising:

roller mounted rotatable endless web means including at least a portion of electrophotographic properties including a front or exposure side and a back side;

drive means for rotating said web sequentially through a set of stations;

said set of stations including:

a charging station located adjacent said front side including corona means for charging said electrophotographic portion while it is in said charging station;

an exposure station following said charging station including means for locating and stopping said electrophotographic portion in said image plane for exposure by said lens system to produce a latent image on said electrophotographic portion;

a toning station following said exposure station including means for applying a substantially constant amount of an ink-receptive toner across the width of only said front side of said imaged electrophotographic portion as it is moved through said toning station to produce a toned image on said electrophotographic portion;

a transfer station following said toning station including means for transferring said toned image from said electrophotographic portion onto a blank lithographic printing plate, including means for moving said transfer medium and said front side of said toned electrophotographic portion into close proximity during said transfer, said transfer station including support roll means disposed against said back side for supporting and positioning said web and electrophotographic portion as it passes through said transfer station; chute means for feeding said transfer medium adjacent to but spaced from said web on said front side; and transfer roll means opposite said support roll means being operative by said moving means to press against said medium to move it into close proximity with said toned electrophotographic portion for transferring said toned image to said transfer medium as it passes through said transfer station between said rolls, and a fixing station following the transfer station for fixing the toned transferred image to the lithographic printing plate.

52. An attachment as claimed in claim 51 wherein said transfer station includes:

transfer bias means for electrically biasing said toned electrophotographic portion relative to said transfer medium and said transfer roll means to assist in the transfer operation.

53. An attachment for use with a graphic arts camera that has a lens system for projecting a light image to an image plane for use in making a lithographic printing plate electrophotographically comprising:

roller mounted rotatable endless web means including at least a portion of electrophotographic properties including a front or exposure side and a back side;

drive means for rotating said web sequentially through a set of stations;

said set of stations including:

a charging station located adjacent said front side including corona means for charging said electrophotographic portion while it is in said charging station;

an exposure station following said charging station including means for locating and stopping said electrophotographic portion in said image plane for exposure by said lens system to produce a latent image on said electrophotographic portion;

a toning station following said exposure station including means for applying a substantially constant amount of an ink-receptive toner across the width of only said front side of said image electrophotographic portion as it is moved through said toning station to produce a toned image on said electrophotographic portion;

a transfer station following said toning station including means for transferring said toned image from said electrophotographic portion onto a blank lithographic printing plate, including means for moving said transfer medium and said front side of said toned electrophotographic portion into close proximity during said transfer, said transfer station including loading platen means having a substantially planar surface including means for holding said transfer medium against said planar surface; said moving means including means for moving said loading platen means surface from a first load and unload position away from said web, to a second transfer position close to but spaced from and substantially parallel to said front side of said web; and roller means disposed adjacent said back side spaced for movement against said back side of said web parallel to said platen means surface to bring said toned electrophotographic portion into close proximity with said transfer medium for transferring said image to said medium.

54. An attachment as claimed in claim 53 wherein said transfer station includes:

transfer bias means for electrically biasing said toned electrophotographic portion relative to said transfer medium and said platen means to assist in the transfer operation.

55. A method for making an ink-receptive image on a blank lithographic printing plate using a graphic arts camera and a rotatably mounted endless web having an electrophotographic surface portion including:

charging said electrophotographic portion;

locating, stopping, and pressing said electrophotographic portion against a planar surface positioned exactly in the image plane of the camera in an exposure station and then exposing said electrophotographic portion to a light image forming a latent image thereon;

forcing said electrophotographic portion away from said planar surface after exposure is completed and moving same to a toning station;

applying a substantially constant amount of toner across the width of only the bottom side of said electrophotographic portion in the toning station and moving the said portion to a transfer station;

transferring an image from said electrophotographic portion to the blank lithographic printing plate in a transfer station; and, thereafter, fixing the toned transferred image to the printing plate.

56. A method as claimed in claim 55 where said toning includes:

applying a liquid toner in a smooth and nonturbulent flow to said electrophotographic portion.

57. A method as claimed in claim 55 wherein said toning includes:

forming a smooth planar reach from said electrophotographic surface portion as it passes through said toning station;

placing a smooth planar toning surface parallel to and spaced from said reach, and, applying the toner in a smooth, nonturbulent flow to said electrophotographic surface portion.

58. A method as claimed in claim 57 wherein said toning includes:

electrically biasing said toning surface relative to said electrophotographic surface portion.

59. A method as claimed in claim 55 including:

applying a positive pressure against said web in said exposure station to push said web away from said planar surface as it rotates through said exposure station.

60. A method as claimed in claim 55 wherein said toning includes:

rolling said toner into close proximity with said electrophotographic surface portion.

61. A method as claimed in claim 55 wherein said transferring includes:

feeding said transfer medium close to but spaced from said web; and moving said transfer medium into close proximity with said electrophotographic surface portion as it passes through said transfer station.

62. A method as claimed in claim 61 wherein said transferring includes:

electrically biasing said transfer medium relative to said electrophotographic surface.

63. A method as claimed in claim 55 wherein said transferring includes:

holding said transfer medium against a planar surface;

forming a planar reach from said web as it passes through said transfer station;

moving said transfer medium parallel to said planar reach;

stopping said electrophotographic surface portion in said planar reach; and sequentially moving said electrophotographic surface portion into close proximity with said transfer medium.

64. A method as claimed in claim 63 wherein said transferring includes:

generating an electrical bias between said electrophotographic surface portion and said transfer medium during transfer.

65. A method as claimed in claim 63 including:

cleaning said electrophotographic surface portion in a cleaning station after it has passed through said transfer station.

66. A method for making an ink-receptive image on a blank lithographic printing plate using a graphic arts camera and a rotatably mounted endless web having an electrophotographic surface portion including the steps of:

charging said electrophotographic surface portion;

locating and stopping said electrophotographic surface portion against a planar surface in an exposure station and then exposing said electrophotographic surface portion to a light image;

forming a smooth planar reach from said electrophotographic surface portion as it passes through said toning station;

placing a smooth planar toning surface parallel to and spaced from said reach;

applying a substantially constant amount of liquid toner in a smooth and nonturbulent flow to the electrophotographic surface portion across the width of only the bottom side of said electrophotographic surface portion in a toning station;

transferring an image from said electrophotographic surface portion to the blank lithographic printing plate in a transfer station; and p1 fixing the toned transferred image to the printing plate.

67. A method as claimed in claim 66 wherein said toning includes:

electrically biasing said surface relative to said electrophotographic surface portion.

68. A method for making an ink-receptive image on a blank lithographic printing plate using a graphic arts camera and a rotatably mounted endless web having an electrophotographic surface portion including:

charging said electrophotographic surface portion;

locating and stopping said electrophotographic surface portion against a planar surface in an exposure station and then exposing said electrophotographic surface portion to a light image;

applying a positive pressure against said web in said exposure station to push said web away from said planar surface as it rotates through said exposure station;

applying a substantially constant amount of toner across the width of only the bottom side of said electrophotographic portion in a toning station;

transferring an image from said electrophotographic portion to the blank lithographic printing plate in a transfer station; and fixing the toned transferred image to the printing plate.

69. A method for making an ink-receptive image on a blank lithographic printing plate using a graphic arts camera having an image plane and a rotatably mounted endless web having an electrophotographic surface portion including:

charging said electrophotographic surface portion;

locating and stopping said electrophotographic surface portion exactly in the image plane engaged against a planar surface lying in said image plane at an exposure station and then exposing said electrophotographic surface portion to a light image while same is in the image plane, forcing the exposed surface portion from said surface to enable movement thereof from said plane surface;

applying a substantially constant amount of liquid toner in a smooth and nonturbulent flow to the electrophotographic surface portion across the width of only the bottom side of said electrophotographic surface portion in a toning station by rolling said toner into close proximity with said electrophotographic surface portion;

transferring an image from said electrophotographic surface portion to the blank lithographic printing plate in a transfer station; and fixing the toned transferred image to the printing plate.

70. A method as claimed in claim 69 including:

cleaning said electrophotographic surface portion in a cleaning station after it has passed through said transfer station.

71. A method as claimed in claim 69 wherein said transferring includes:

electrically biasing said transfer medium relative to said electrophotographic surface portion.

72. A method for making an ink-receptive image on a blank lithographic printing plate using a graphic arts camera and a rotatably mounted endless web having an electrophotographic surface portion including:

charging said electrophotographic surface portion;

locating and stopping said electrophotographic surface portion against a planar surface in an exposure station and then exposing said electrophotographic surface portion to a light image;

forming a smooth planar reach from said electrophotographic surface portion as it passes through said toning station; and placing a smooth planar toning surface parallel to and spaced from said reach;

applying a substantially constant amount of liquid toner in a smooth and nonturbulent flow to the electrophotographic surface portion across the width of only the bottom side of said electrophotographic surface portion in a toning station by rolling said toner into close proximity with said electrophotographic surface portion;

transferring an image from said electrophotographic surface portion to the blank lithographic printing plate in a transfer station; and fixing the toned transferred image to the printing plate.

73. A method as claimed in claim 72 wherein said toning includes:

electrically biasing said surface relative to said electrophotographic surface portion.

74. A method for making an ink-receptive image on a blank lithographic printing plate using a graphic arts camera and a rotatably mounted endless web having an electrophotographic surface portion including:

charging said electrophotographic surface portion;

locating and stopping said electrophotographic surface portion in close proximity to a planar surface at an exposure station placing said electrophotographic surface exactly in the image plane and then exposing said electrophotographic surface portion to a light image while the said surface portion is immobilized in said image plane;

forcing the said surface portion outwardly away from said image plane enabling movement of same from said exposure station;

applying a substantially constant amount of liquid toner in a smooth and nonturbulent flow to the electrophotographic surface portion across the width of only the bottom side of said electrophotographic surface portion in a toning station;

transferring an image from said electrophotographic surface portion to the blank lithographic printing plate in a transfer station by feeding said transfer medium close to but spaced from the web; and moving said transfer medium into close proximity with said electrophotographic surface portion as it passes through said transfer station; and fixing the toned transferred image to the printing plate.

75. A method as claimed in claim 74 wherein said transferring includes:

electrically biasing said transfer medium relative to said electrophotographic surface portion.

76. A method for making an ink-receptive image on a blank lithographic printing plate using a graphic arts camera and a rotatably mounted endless web having an electrophotographic surface portion including:

charging said electrophotographic surface portion;

locating and stopping said electrophotographic surface portion against a planar surface in an exposure station and then exposing said electrophotographic surface portion to a light image;

applying a substantially constant amount of liquid toner in a smooth and nonturbulent flow to the electrophotographic surface portion across the width of only the bottom side of said electrophotographic portion in a toning station;

transferring an image from said electrophotographic surface portion to the blank lithographic printing plate in a transfer station by holding said transfer medium against a planar surface; forming a planar reach from said electrophotographic surface portion as it passes through said transfer station; moving said transfer medium parallel to said planar reach; stopping said electrophotographic surface portion in said planar reach; and sequentially moving said electrophotographic surface portion into close proximity with said transfer medium; and fixing the toned transferred image to the printing plate.

77. A method as claimed in claim 76 wherein said transferring includes:

electrically biasing said electrophotographic surface portion relative to said transfer medium.

* * * * *

UNITED STATES PATENT AND TRADEMARK OFFICE

CERTIFICATE OF CORRECTION

PATENT NO. : 4,275,957

DATED : June 30, 1981

INVENTOR(S) : Manfred R. Kuehnle & George J. Perry

It is certified that error appears in the above-identified patent and that said Letters Patent is hereby corrected as shown below:

Column 14, line 12, "11" should read --26--

Column 18, line 58, "respective" should read --receptive--

Column 23, line 32, delete "pl".

Signed and Sealed this

Twenty-first Day of October, 1986

[SEAL]

*Attest:*

DONALD J. QUIGG

*Attesting Officer*

*Commissioner of Patents and Trademarks*